United States Patent [19]

Schmidt et al.

[11] Patent Number: 4,713,948

[45] Date of Patent: Dec. 22, 1987

[54] DOUBLE BED FLAT KNITTING MACHINE WITH SINKERS LOCATED BETWEEN THE NEEDLES

[75] Inventors: Henning Schmidt; Walter Nedele, both of Reutlingen; Hermann Schmodde, Albstadt, all of Fed. Rep. of Germany

[73] Assignee: H. Stoll GmbH & Co., Fed. Rep. of Germany

[21] Appl. No.: 29,195

[22] Filed: Mar. 23, 1987

[30] Foreign Application Priority Data

Mar. 21, 1986 [DE] Fed. Rep. of Germany ..... 3609539

[51] Int. Cl.[4] ..... D04B 15/06; D04B 15/24

[52] U.S. Cl. ..... 66/106

[58] Field of Search ..... 66/106, 109, 104

[56] References Cited

U.S. PATENT DOCUMENTS

| | | | |
|---|---|---|---|
| 616,600 | 12/1898 | Burson | 66/106 X |
| 616,601 | 12/1898 | Burson | 66/106 X |
| 1,339,708 | 5/1920 | Lippitt | 66/106 |
| 3,326,017 | 6/1967 | Tschumperlin et al. | 66/104 X |
| 3,362,195 | 1/1968 | Goisis | 66/106 |
| 3,440,839 | 4/1969 | Tschumperlin | 66/106 X |
| 3,735,812 | 5/1973 | Flavell | 66/104 |

*Primary Examiner*—Ronald Feldbaum

*Attorney, Agent, or Firm*—Larson and Taylor

[57] ABSTRACT

The sinkers of both needle beds of a double bed flat knitting machine are pivotable so as to form a complete bridge over the gap between the needle beds. They have a loop-forming edge which is formed, with respect to the direction of take down for the knitted fabric, underneath the projections of the sinkers, which make up the bridge. Holding down of the old stitches in the gap between the needle beds is therefore ensured and a loop equalizing movement can be effected by means of the sinkers.

5 Claims, 17 Drawing Figures

DOUBLE BED FLAT KNITTING MACHINE WITH SINKERS LOCATED BETWEEN THE NEEDLES

The invention relates to a double bed flat knitting machine having needles which are longitudinally movable in their needle beds and sinkers between the needles which are movable about a common longitudinal axis between a rear and a forward position and which are controlled by cam elements of the cam carriage, the sinkers being provided, in the stitch-forming region, with a projection, with a stitch-receiving throat underneath the projection and with a loop-forming edge.

Flat knitting machines with the above mentioned characteristics are known (see for example, Swiss Pat. No. 73088 and German Publication No. 1585083). The pivotable sinkers therein replace a loop-forming edge on the needle beds and, when the needles are raised, hold down, with their stitch-receiving throats, the loops hanging on the needles. In modern flat knitting machines operating at higher speeds, the problem of holding down the so-called old stitches away from the operating region of the needle heads during the trapping of the yarn for the formation of new stitches or loops enters more strongly into the picture.

It has previously been attempted to press down the old stitches in the direction of a take-down device for the knitted fabric with the aid of stroking elements which move with the cam carriage of the flat knitting machine and extend down into the gap between the needle beds of the flat knitting machine. However, stroking elements have the disadvantage that they are direction-dependant and must therefore be switched over when the cam carriage changes direction. Further, different stroking elements are required for different types of knitting so that frequent changing of stroking elements must take place. Further disadvantages are that a stroking element always acts on several adjacent stitches at the same time and that the stroking elements, which are generally made from wire, can easily be bent out of shape and this can lead to yarns being caught up. Stroking elements also make it difficult to see into the needle bed gap and they frequently collide with the brushes for opening the latches of the flat knitting machine. In some designs where it is necessary to shog the needle beds, the stroking elements must even be switched out of action so that they cannot then be effective in any way.

The sinkers known hitherto, which co-operate with the needles of the two needle beds of the flat knitting machine, do not permit an ideal solution of the present problem, because, in their case, drawing the yarn into loops and operating on the drawn yarn creates difficulties. With the known sinkers, drawing the yarn into loops takes place, with respect to the direction of take-down of the knitted fabric, in front of the stitch-receiving throat, specifically on a projection of the sinker, which borders the stitch-receiving throat. The control possibility of the sinkers is thereby reduced, because the yarn drawn into a loop must, in each case, be able to slip off the projection of the sinker bordering the stitch-receiving throat in a downwards direction. A gap must remain between the sinkers of the two needle beds, which co-operate with one another, which allows the yarn drawn into a loop to slip back onto the sinker. Thus, there remains, despite the stitch-receiving throats, the not inconsiderable danger in the case of machines operating at high speed, that an old stitch may be pulled upwards out of the needle bed gap by the needles during their rising movement.

The problem constituting the basis of the invention is to form the sinkers of a double bed flat knitting machine of the type described such that the stitches are reliably retained out of the region of the rising needles without having to tolerate any hindrance or restriction in the normal knitting operation.

The above described problem is solved according to the invention in that the loop forming edge of the sinkers is formed, with respect to the direction of take-down for the knitted fabric, after the underneath the yarn-receiving throat, and is further characterized in that the sinkers of the two needle beds are located opposite one another and in their forward position, in which they form the bridge over the gap between the needle beds, are in contact with one another through their projections. Advantageously, the sinkers may have a short slot, in the shape of an arc of a circle, behind and slightly below the loop-forming edge and which has a closed periphery and through which is threaded a wire forming the knocking-over edge of the associated needle bed.

In the flat knitting machine according to the invention, the yarn is laid over the sinkers underneath the projection of the sinkers, which closes the needle bed gap at the top. Slipping of yarn drawn into loops over the projections of the sinkers does not occur, so that there is free reign for controlling the sinkers. At the completion of the loop-drawing operation, the stitches which have been formed are free and are not confined by the sinkers, so that shogging of the needle bed or transfer of stitches can be effected. Starting a knitting procedure with empty needles does not cause any problem. By moving the sinkers in the direction to close the needle bed gap during the last part of the retracting movement of the needles, it becomes possible to effect a stitch length equalizing operation by means of the sinkers through the agency of the loop-forming edge lying underneath the projection of the sinkers, which effects closure of the needle bed gap, which is desirable when knitting with the needles of one of the two needle beds only in order always to maintain the same stitch length. Further, the needle beds have their own knock-over edge in the known form of a wire.

Stroking elements can be dispensed with. The machine is always operated with the same sinkers, irrespective of whether single jersey or double jersey fabric is produced. Holding down of the old stitches is completely ensured, and thus the dependence upon and therefore, the importance of the construction of a take-down device for the knitted fabric located underneath the needle bed gap is reduced. In addition, devices for maintaining the width of the completed fabric lose importance. The stitch of each needle is individually held down by the associated sinker. Increase in the speed of operation of a flat knitting machine constructed according to the invention no longer causes any problem with respect to holding down the stitches of the knitting being taken down.

An embodiment of a flat knitting machine constructed according to the invention is described in greater detail below with reference to the accompanying drawings wherein.

Figure 1:
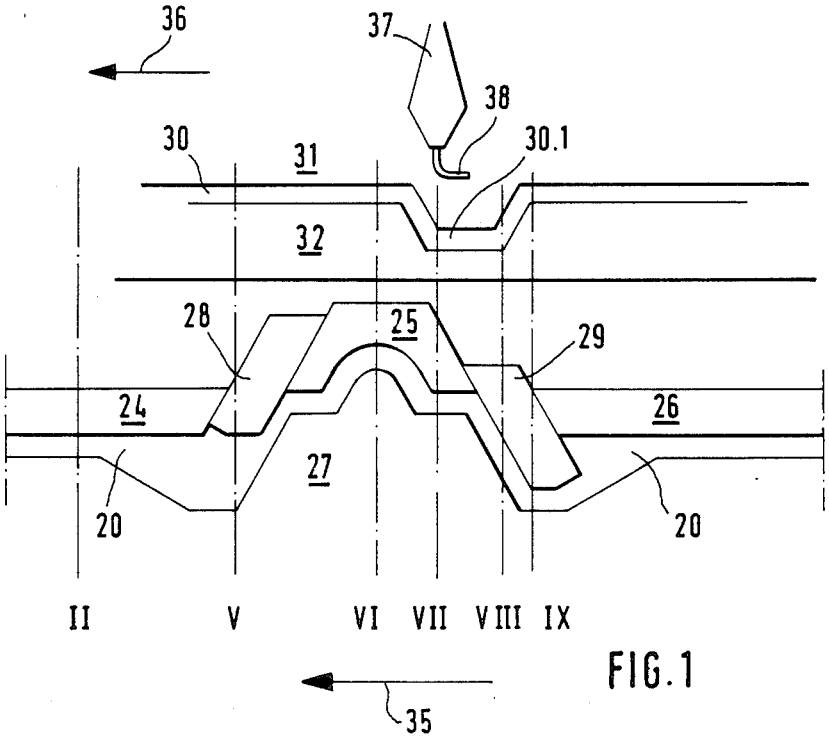
FIG. 1 is a schematic representation of the knitting cam box of a flat knitting machine with associated cam elements for controlling the sinkers.
Figure 2:
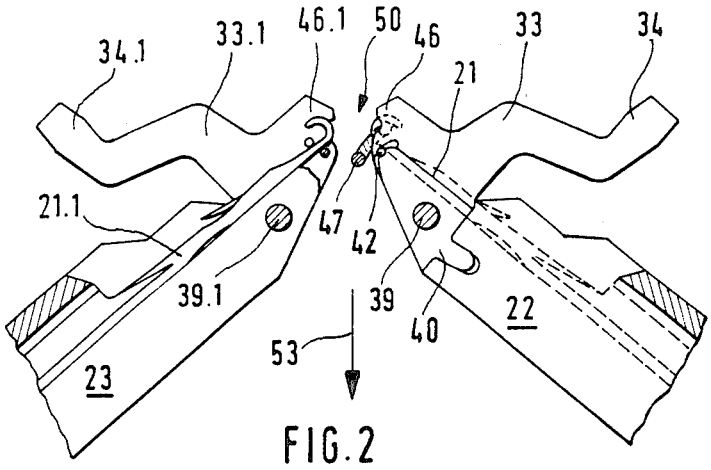
FIG. 2 is a partial cross-section through the two needle beds in the region of the needle bed gap of the flat knitting machine at the position II of the cam box of FIG. 1.
Figure 5:
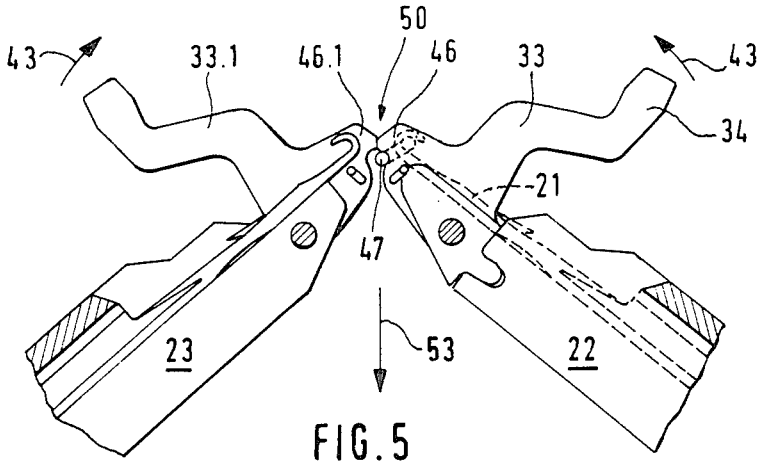
Figure 6:
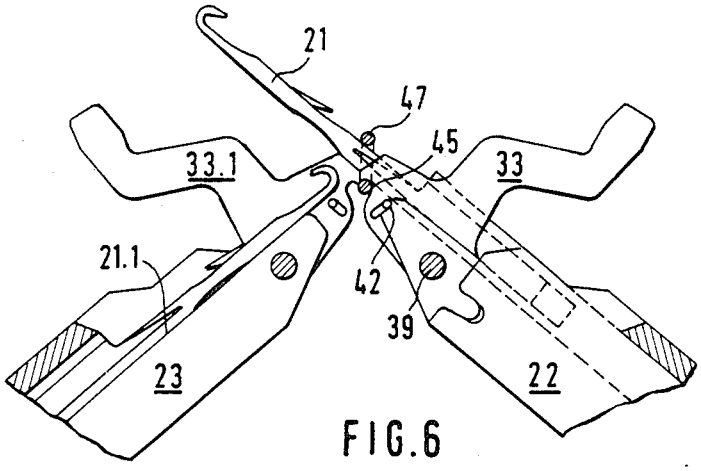
Figure 7:
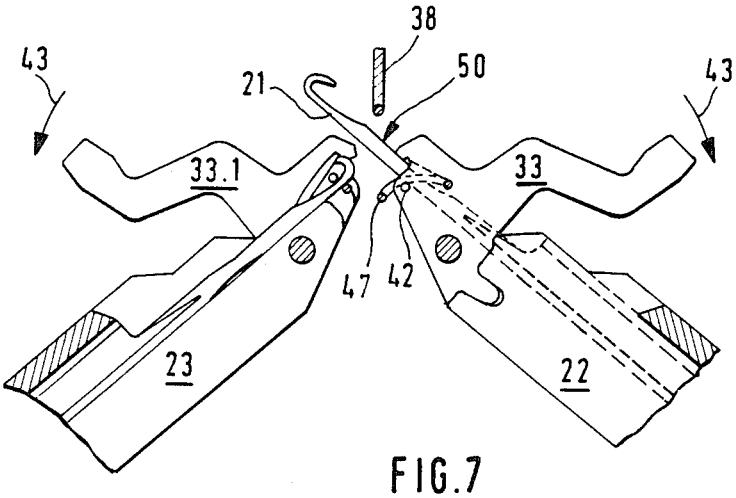
Figure 8:
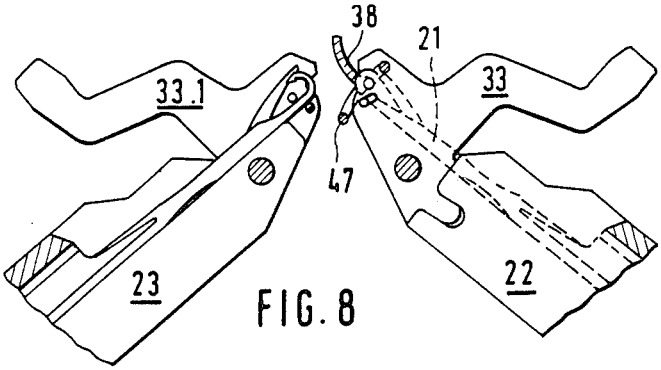
Figure 9:
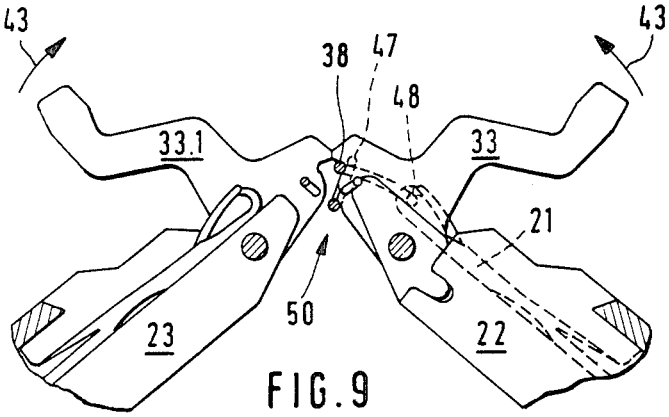
Figure 10:
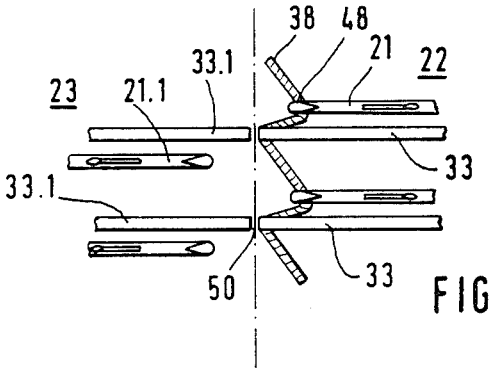
Figure 11:
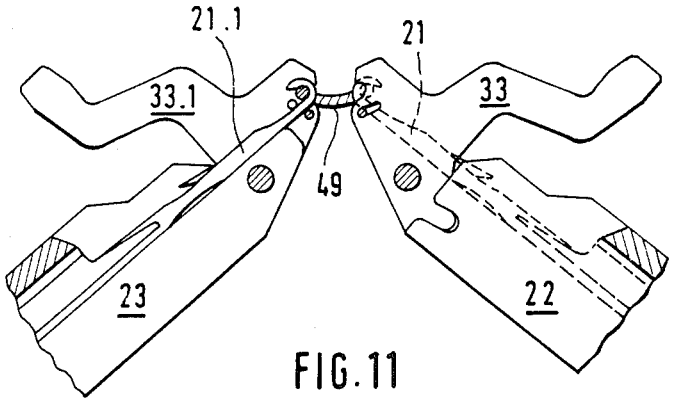

FIG. 5 corresponds to FIG. 2 at the position V of the cam box of FIG. 1;

FIG. 6 corresponds to FIG. 2 at the position VI of the cam box of FIG. 1 during production of a piece of single jersey knitting;

FIG. 7 corresponds to FIG. 2 at the position VII of the cam box of FIG. 1 during production of a piece of single jersey knitting;

FIG. 8 corresponds to FIG. 2 at the position VIII of the cam box of FIG. 1 during production of a piece of single jersey knitting;

FIG. 9 corresponds to FIG. 2 at the position IX of the cam box of FIG. 1 during production of a piece of single jersey knitting;

FIG. 10 is a partial plan view of the needle bed gap region of the flat knitting machine at the position IX of the cam box during production of a piece of single jersey knitting;

FIGS. 11–16 correspond to FIGS. 2 and 5–9 at the positions II, V–IX of the cam box of FIG. 1 during the production of a piece of double jersey knitting; and specifically FIG. 11 corresponds to FIG. 2 and thus to the control conditions at the cam position II in FIG. 1.

Figure 12:
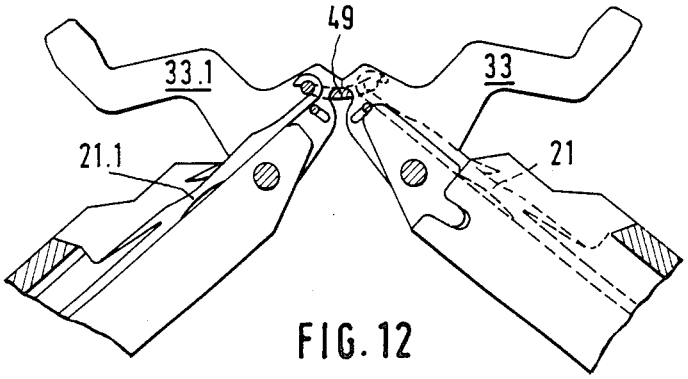

FIG. 12 corresponds to FIG. 5 and thus to the control conditions at the cam position V in FIG. 1.

Figure 13:
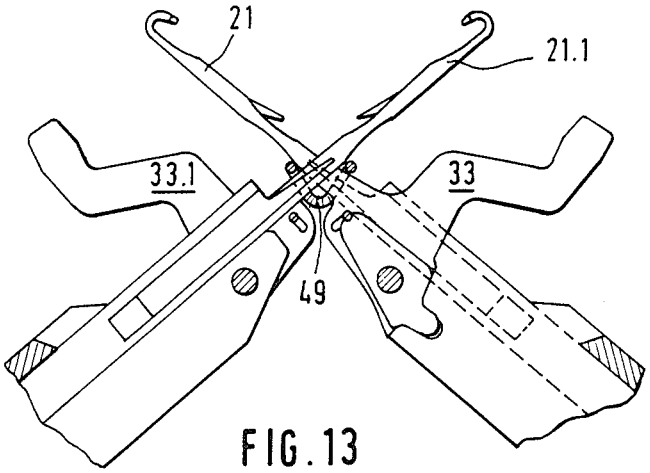

FIG. 13 corresponds to FIG. 6 and thus to the control conditions at the cam position VI in FIG. 1.

Figure 14:
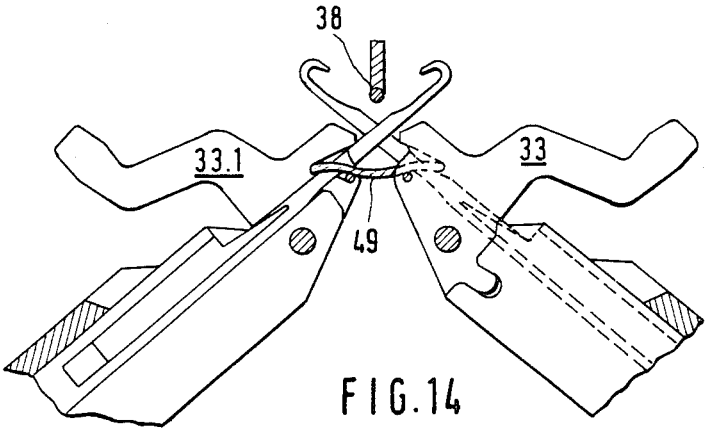

FIG. 14 corresponds to FIG. 7 and thus to the control conditions at the cam position VII in FIG. 1.

Figure 15:
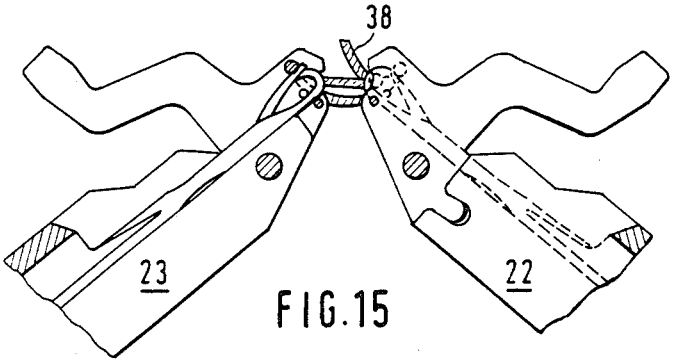

FIG. 15 corresponds to FIG. 8 and thus to the control conditions at the cam position VIII in FIG. 1.

Figure 16:
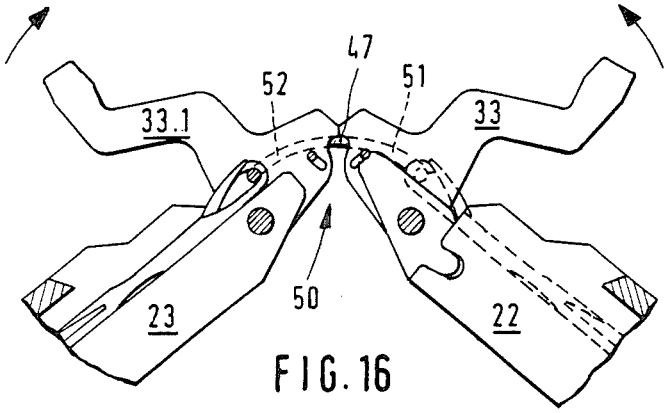

FIG. 16 corresponds to FIG. 9 and thus to the control conditions at the cam position IX in FIG. 1.

Figure 17:
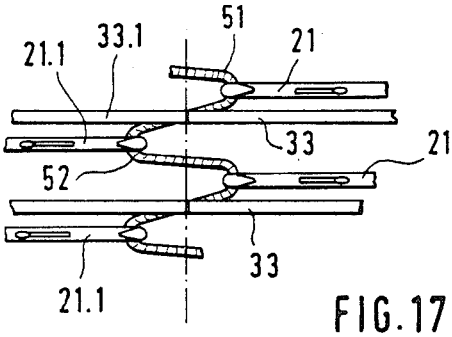

FIG. 17 is a partial plan view of the needle bed gap region of the flat knitting machine corresponding to FIG. 10 at the position IX of the cam box during the production of a piece of double jersey knitting.

The schematic representation in FIG. 1 of a cam box of the cam carriage, which is not shown, of a flat knitting machine shows a cam track 20 for controlling the needles 21 of the front needle bed 22 or the needles 21.1 of the rear needle bed 23 (FIG. 2) of a flat knitting machine. The needle control track 20 is bordered in a known manner by fixed cam elements 24, 25, 26, 27 and two lowering cam elements 28 and 29, adjustable in a known manner. The knitting cam box also has a cam track 30 formed between cam elements 31 and 32 for the similarly formed sinkers 33 of the front needle bed 22 or the sinkers 33.1 of the rear needle bed 23, which extend by means of a control butt 34, 34.1 into the sinker cam track 30. The needles 21, 21.1 and the sinkers 33, 33.1 of the two needle beds 22 and 23 are set up sequentially. FIG. 1 shows the knitting cam box adjusted for the direction of cam carriage movement indicated by an arrow 35. When the cam carriage reversal takes place, the lowering cam elements 28, 29 are moved in a known manner in opposite directions. In addition, the sinker cam elements 31, 32 are moved as a unit in the direction of the arrow 36 of FIG. 1, so that the region 30.1 of the sinker cam reaches the position of the lowering cam element 28. In FIG. 1 a yarn feeder 37 is also shown, which, in the region 30.1 of the sinker cam leads a yarn 38 to the needles 21 and/or 21.1.

Figure 4:
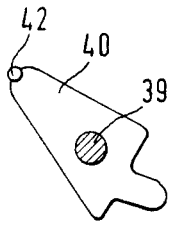
FIG. 4 shows an individual stitch-forming projection of the needle beds.
Figure 3:
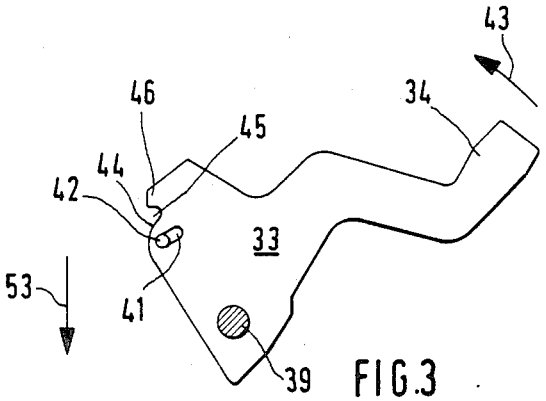
FIG. 3 shows an individual sinker of the flat knitting machine.

As shown in FIG. 3, the sinkers 33 have an aperture for a pivot axle 39 or 39.1 (FIG. 2) common to all the sinkers 33 of a needle bed 22 or 23, on which the stitch-forming projections 40 are arranged in line, a single one of which is shown in FIG. 4, and which are arranged in each case between the sinkers 33 in the needle beds 22 and 23. The sinker 33 has, in addition, a short slot 41 in the shape of an arc of a circle and with a closed periphery, through which a wire 42 is threaded, held by the stitch-forming projections 40 which forms, in each case, the knocking-over edge of a needle bed. The arc shaped slot 41 limits the pivotal movement of the sinkers about the common axle 39 from a rearward position shown in FIG. 3 in the direction of the arrow 43 of FIG. 3, to a forward position, which occurs in the neighborhood of the region 30.1 of the sinker cam track. The arc shaped slot 41 is located behind a loop-forming edge 44 of the sinker, which adjoins a stitch-receiving throat 45, which, in turn is formed with respect to the direction 53 of knitting take-down, indicated by an arrow, beneath a projection 46 of the sinker 33.

In FIG. 1 various cam positions II, V, VI, VII, VIII, IX are marked by vertical, chain-dotted lines. FIGS. 2, 5, 6, 7, 8 and 9 show the position of the sinkers 33 and 33.1 as well as the position of the needles 21 and 21.1 of both needle beds 22 and 23 at these positions during the production of a piece of single jersey knitting, when, therefore, only the needles 21 of the front needle bed 22 operate on a yarn 38.

FIG. 2 shows that at the cam position II the sinkers 33 of the front needle bed 22 and the sinkers 33.1 of the rear needle bed 23 are located in their rearward position, in which they do not extend into the bed gap 50 of the flat knitting machine. An old stitch 47 hangs in the head of the needle 21.

FIG. 5 shows the position of the knitting elements at the position V of the cam representation of FIG. 1, before the start of the outward movement of the needle. The sinkers 33 and 33.1 of both needle beds 22 and 23 are pivoted at the same time in the direction of the arrows 43 by the sinker cam track 30 into their forward position, in which their projections 46 and 46.1 lie against one another.

The bed gap 50 is thus bridged by the sinkers 33 and 33.1, so that during the accompanying outward movement of the needles 21 of the front needle bed 22 into the position visible in FIG. 6, which they take up at the position VI of FIG. 1, the old stitch 47 slides into the stitch-receiving throat 45 of the associated sinker 33 and cannot slide up out of the bed gap 50. In the needle bed 23, only the sinkers 33.1 are actively controlled. The needles 21.1 remain still.

Before the start of the laying-in of the yarn, the sinkers 33 and 33.1 of both needle beds 22 and 23 are pivoted back into their rearward position by the sinker cam track 30 due to movement into the section 30.1 of the sinker cam track, as FIG. 7 shows for the cam position VII and as indicated by the arrow 43. The bed gap 50 of the flat knitting machine is once more open and the yarn 38 can be introduced, unhindered, by the yarn feeder 37 (FIG. 1) into the region of movement of the needles 21 of the front needle bed 22. The old stitch 47 hangs on the shaft of the needle 21 and lies against the wire forming the stitch knocking-over edge 42 of the front needle bed 22. During the accompanying retraction of the needles 21 to the position visible in FIG. 8 at the cam position VIII of FIG. 1, the sinkers 33 and 33.1 remain held, due to the section 30.1 of the sinker cam track, in their rearward position. At the cam position VIII, the yarn 38 seized by the head of the needle 21 is pulled into the old stitch 47. From this position of retraction, the sinkers are pivoted back again by the sinker cam track 30 into their forward position during the further retraction of the needles 21 of the front needle bed 22 to the deepest retracted position visible in FIG. 9 at the position IX of the cam according to FIG. 1, as indicated by the arrow 43 in FIG. 9. By this movement from the rearward into the forward position, the loop-forming edge 44 (FIG. 3) of the sinkers 33 and 33.1, over which the yarn 38 is pulled down to form the new stitch 48 comes to lie, moves into the bed gap 50, whereby an increase in the length of the newly formed stitch 48 is effected through an auxiliary stitch-drawing movement of the yarn 38 by means of the sinkers 33. FIG. 10 shows the path of the yarn 38 at this position, drawn into new stitches 48 over the needles 21 and the sinkers 33 of the needle bed 22. To show this clearly in FIG. 10, the old stitches 47 are no longer represented.

FIGS. 11 to 17 are similar to FIGS. 2 and 5 to 10 except that they show the position of the parts for the production of a piece of double jersey knitting, when the needles 21 of the front needle bed 22 and the needles 21.1 of the rear needle bed 23 are in operation together with the sinkers 33 and 33.1. Therefore, a detailed description of FIGS. 11–17 is not necessary.

Generally, however, FIGS. 11 and 12 show the connecting curve 49 of yarn between the old stitches held by the needles 21 and 21.1 of the two needle beds; FIG. 13 shows how, on the outward movement of the needles 21 and 21.1, the old stitches on these connecting curves 49 are held back by the sinkers 33 and 33.1 located in their forward position; and FIG. 14 shows the newly laid-in yarn 38, from which new stitches 51 and 52 are pulled on the two needle beds 22 and 23 in FIG. 16. Here also, there occurs an auxiliary loop-drawing movement to equalize the length of the new stitches 51 by the loop-forming edges 47 of the sinkers 33 and 33.1 which have been moved into the bed gap 50.

We claim:

1. A double bed flat knitting machine having needles, which are longitudinally movable in their needle beds, and sinkers between the needles, which sinkers are movable about a common longitudinal axis between a rear and a forward position and which are controlled by cam elements of the cam carriage, the sinkers being provided, in the stitch-forming region, with a projection, with a stitch-receiving throat underneath the projection and with a loop-forming edge, characterized in that the loop-forming edge of each sinker is formed, with respect to the direction of take-down of the knitted fabric, after and underneath the yarn-receiving throat, and further characterized in that the sinkers of the two needle beds are located opposite one another, and in their forward position, in which they form the bridge over the gap between the needle beds are in contact with one another through their projections.

2. A double bed flat knitting machine according to claim 1, characterized in that the sinkers have a short slot, in the shape of an arc of a circle, behind and slightly below the loop-forming edge and which has a closed periphery and through which is threaded a wire forming the knocking-over edge of the associated needle bed.

3. A double bed flat knitting machine according to claim 2, characterized in that the cam elements, which control the sinkers, are mounted in the cam carriage so as to be adjustable as a unit in the direction of movement of the cam carriage with respect to cam elements, which control the needles.

4. A double bed flat knitting machine according to claim 1, characterized in that the cam elements, which control the sinkers, are mounted in the cam carriage so as to be adjustable as a unit in the direction of movement of the cam carriage with respect to cam elements, which control the needles.

5. A method for the production of a knitted fabric on a double bed flat knitting machine of the type having needles which are longitudinally movable in their needle beds, and sinkers between the needles, which are movable about a common longitudinal axis between a rear and a forward position and which are controlled by cam elements of the cam carriage, the sinkers being provided, in the stitch-forming region, with a projection, with a stitch-receiving throat underneath the projection and with a loop-forming edge, in which the loop-forming edge of each sinker is formed, with respect to the direction of take-down of the knitted fabric, after and underneath the yarn-receiving throat and in which the sinkers of the two needle beds are located opposite one another, and in their forward position, in which they form the bridge over the gap between the needle beds are in contact with one another through their projections, which method comprises the following steps:

(a) moving the needles into their retracted position and retaining the sinkers in their rear position;

(b) pivoting of the sinkers into their forward position, in which they bridge the gap between the needle beds, before the outward movement of the needles begins, and retaining the sinkers in the forward position with the old stitches held in the throats of the sinkers during the whole of the outward movement of the needles;

(c) pivoting the sinkers rearwardly into their rear position before laying in of the yarn takes place and the retraction of the needles begins;

(d) retaining the sinkers in the rear position until the heads of the needles holding the laid-in yarn have passed the level of the stitch-forming edge of the sinkers, during the retraction and have been moved through the old stitches; and (e) pivoting the sinkers into their forward position during the remainder of the retraction movement of the needles with the laid-in yarn against their loop-forming edge.

* * * * *